US005336525A

United States Patent [19]

Jen

[11] Patent Number: 5,336,525

[45] Date of Patent: Aug. 9, 1994

[54] STAMP PAD AND THE METHOD FOR PRODUCING THE SAME

[75] Inventor: Richard Jen, Kaohsiung City, Taiwan

[73] Assignee: Sheenya Enterprises Co., Ltd., Feng Shan City, Taiwan

[21] Appl. No.: 6,319

[22] Filed: Jan. 21, 1993

[51] Int. Cl.[5] ..... B05D 5/00

[52] U.S. Cl. ..... 427/256; 427/275; 427/358; 427/384; 427/385.5

[58] Field of Search ..... 427/256, 275, 245, 385.5, 427/358, 384

[56] References Cited

U.S. PATENT DOCUMENTS

| | | | |
|---|---|---|---|
| 3,646,909 | 3/1972 | Dudley | 118/264 |
| 3,814,014 | 6/1974 | Dahlgren | 101/137 |
| 3,839,955 | 10/1974 | Klapholz | 101/334 |

*Primary Examiner*—Janyce Bell

*Attorney, Agent, or Firm*—Willian Brinks Hofer Gilson & Lione

[57] ABSTRACT

A stamp pad and the method for producing the stamp pad are disclosed. The stamp pad has a piece of porous padding member padded in a case. The porous padding member has a plurality of regions provided respectively with stamping ink of different colors. The method for producing a stamp pad includes compressing a piece of porous padding member by means of a hot pressing plate; preparing high concentration stamping ink of different colors; diluting the high concentration stamping ink with a diluent; depressing a die with a plurality of partitions on the porous padding member in order to form different regions on the porous padding member; adding the diluted stamping ink of different colors into the regions of the porous padding member; vacuum drying the porous padding member to remove the diluent in the porous padding member; and removing the die.

4 Claims, 3 Drawing Sheets

STAMP PAD AND THE METHOD FOR PRODUCING THE SAME

BACKGROUND OF THE INVENTION

1. Field of the Invention

This invention relates to a stamp pad and the method for producing the same, more particularly to a stamp pad which has a plurality of differently colored regions provided respectively with different colors and the method for producing the same.

2. Description of the Related Art

Referring to FIG. 1, a perspective view of a conventional stamp pad 1 shows the stamps pad 1 to include a case 11 which has a plurality of foam strips 12 padded therein in a juxtaposed relationship. The foam strips 12 are respectively provided with stamping ink of different colors. Therefore, when a stamp or seal is stamped on the foam strips 12 of the stamp pad 1, the stamp or seal can stamp a pattern of different colors. Note that the color distribution of the pattern is strip-like due to the arrangement of the foams 12 of the stamp pad 1. Such a color distribution is monotonous. In addition, because the foam strips 12 must be individually provided with different colors and then adhered to the case 11, the processes for manufacturing the conventional stamp pad 1 is troublesome.

SUMMARY OF THE INVENTION

It is an object of this invention to provide a stamp pad which has a padding member that is provided with differently colored regions which can be arranged as desired in order to provide a pattern with a variety of color distributions.

It is another object of this invention to provide a method for producing a stamp pad which can provide a pattern with a variety of color distributions.

Accordingly, one aspect of this invention is that the stamp pad has a piece of porous padding member which is padded in a case. The porous padding member has a plurality of regions provided respectively with stamping ink of different colors.

Another aspect of this invention is that the method for producing a stamp pad comprises the steps of:

(1) compressing a piece of porous padding member by means of a hot pressing plate;

(2) preparing high concentration scamping ink of different colors;

(3) diluting the high concentration stamping ink with a diluent in order to increase the flow ability and permeability of the stamping ink;

(4) depressing a die with a plurality of partitions on the porous padding member in order to form different regions on the porous padding member;

(5) adding the diluted stamping ink of different colors into the regions of the porous padding member; and (6) vacuum drying the porous padding member to remove the diluent in the porous padding member.

Other features and advantages of this invention will become apparent in the following detailed description of the preferred embodiments of this invention with reference to the accompanying drawings.

DETAILED DESCRIPTION OF THE PRESENTLY PREFERRED EMBODIMENTS

Figure 1:
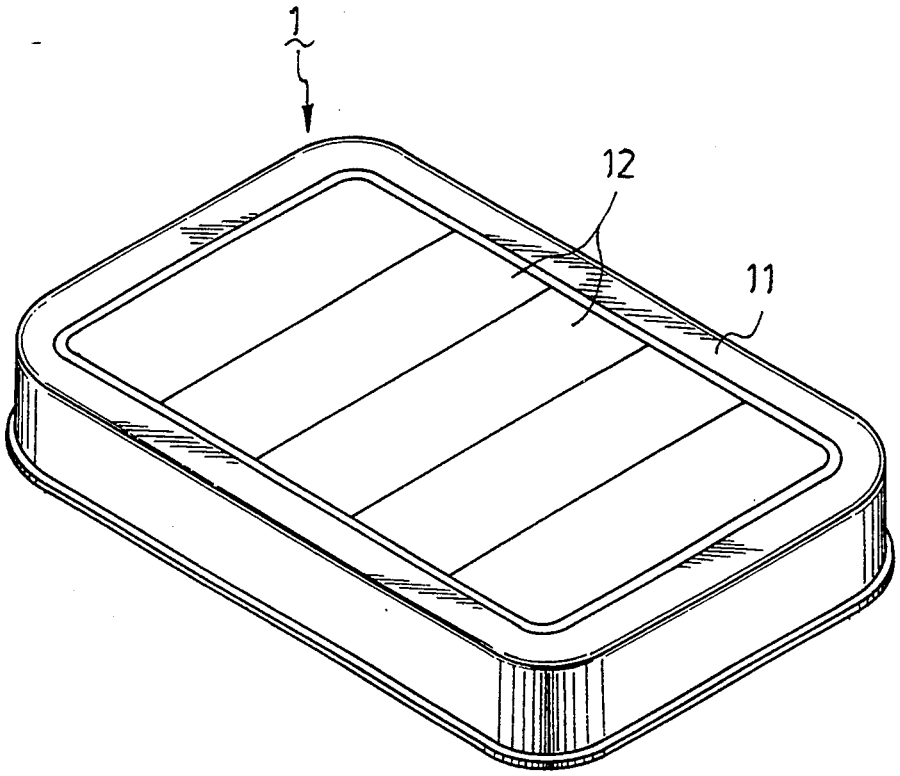
FIG. 1 (PRIOR ART)
FIG. 1 is a perspective view of a conventional stamp pad which has foam strips provided with different colors.
Figure 2:
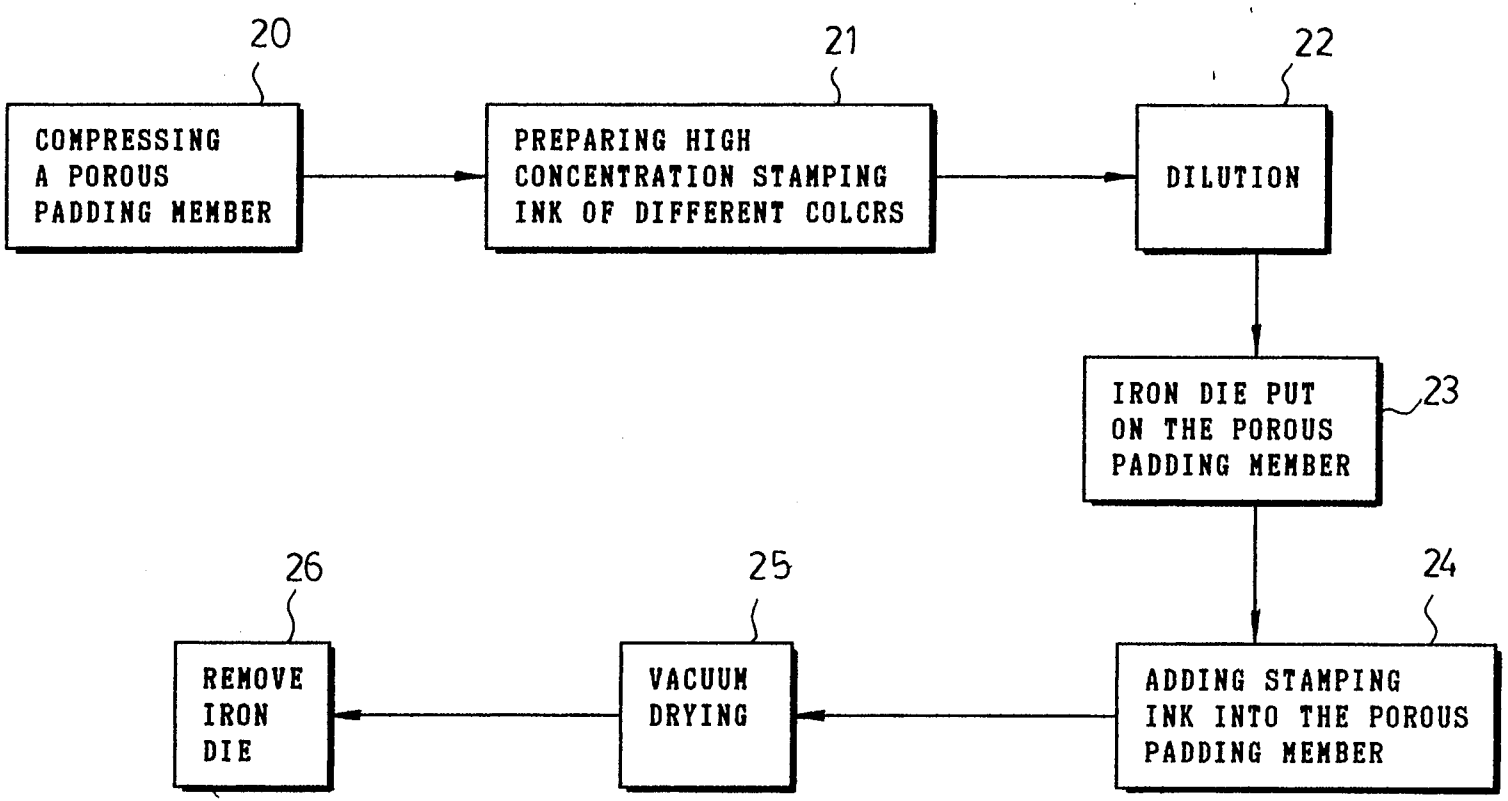
FIG. 2 is a flow diagram of a preferred embodiment of a method for producing a stamp pad of this invention.

FIG. 2 is a flow diagram of a preferred embodiment of a method for producing a stamp pad of this invention. A piece of porous padding member is compressed in order to provide a low compressibility to the porous padding member by means of a hot pressing plate at 180° C. which is driven by a hydraulic cylinder, as shown in block 20. High concentration stamping ink of different colors is then prepared, as shown in block 21. A diluent is added to the high concentration stamping ink in order to increase the flowability and permeability of the stamping ink, as shown in block 22. An iron die with a plurality of partitions depresses the porous padding member in order to form a plurality of preset regions on the porous padding member, as shown in block 23. The diluted stamping ink of different colors are respectively added to the preset regions of the porous padding member, as shown in block 24. The porous padding member is dried in a vacuum dryer in order to remove the diluent, as shown in block 25. Finally, the iron die is removed, as shown in block 26.

The composition of the high concentration stamping ink of this invention comprises 50to 70% by weight of glycerine, 10 to 15% by weight of pigment, 15 to 20% by weight of adhesion-enhancing suspension agent, and 5 to 12% by weight of a quick-setting agent. In this embodiment, 100 g glycerine, 20 g pigment, 30 g poly vinyl purrolidone, which is used as an adhesion-enhancing suspension agent, and 10 g lanolin, which is used as a quick-setting agent, are mixed to form high concentration ink which has a viscosity of 71,500 cps. The adhesion-enhancing suspension agent can increase the viscosity of the stamping ink, while the quick-setting agent can make the stamping ink permeate quickly into the paper after stamping.

In this embodiment, the diluent which is added to the high concentration stamping ink is water. The ratio of the amount of the water and the high concentration stamping ink is 5/1. The diluted stamping ink has a viscosity of 1,500 cps.

The porous padding member of this invention is a foam. The compressed foam has a hardness of shore c 30 and a compression set below 40%.

The partitions of the iron die divide the porous padding member into a plurality of regions which form a predetermined pattern. The different colors of diluted stamping ink are then poured into the regions of the porous padding member until the content of the stamping ink in the porous padding member is 80 to 100% of the saturation content of the porous padding member.

Next, the porous padding member is vacuum dried in a vacuum dryer in order to remove the diluent contained in the stamping ink. The stamping ink is then concentrated and therefore has a low flowability. Hence, the stamping ink in different regions of the porous padding member will not mix with one another and will be uniformly distributed in the respective regions.

Figure 3:
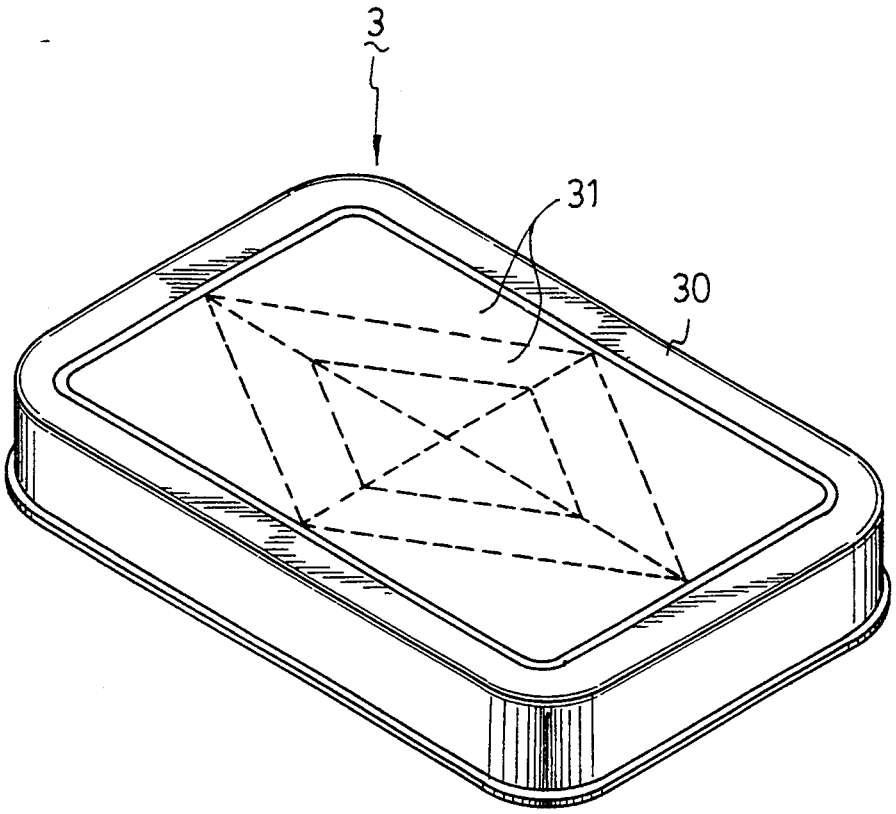
FIG. 3 is a perspective view of a preferred embodiment of a stamp pad of this invention.

FIG. 3 shows a perspective view of a preferred embodiment of a stamp pad 3 which is manufactured according to the method of this invention. A piece of foam 31 is padded in a case 30. The foam 31 has a plurality of regions which form a predetermined pattern. The regions are defined by the dotted lines and are provided respectively with stamping ink of different colors. The pattern and area of the regions can be changed as desired so as to vary the color distribution of the pattern to be stamped. Since the stamping ink has low flowability, the stamping ink in the regions will not mix with one another. The stamping ink in the foam 31 will properly permeate off the foam when a stamp or seal depresses the foam because the stamping ink contains an adhesion-enhancing suspension agent.

With this invention thus explained, it is apparent that numerous modifications and variations can be made without departing from the scope and spirit of this invention. It is therefore intended that this invention be limited only as indicated in the appended claims.

I claim:

1. A method for producing a stamp pad comprising the steps of:

(1) compressing a piece of porous padding member by means of a hot pressing plate;

(2) preparing stamping ink of different colors;

(3) diluting said stamping ink with a diluent to a viscosity of 1500 cps in order to increase the flowability and permeability of said stamping ink;

(b 4) depressing a die with a plurality of partitions on said porous padding member in order to form different regions on said porous padding member;

(5) adding said diluted stamping ink of different colors into said regions of said porous padding member;

(6) vacuum drying sad porous padding member to remove said diluent in said porous padding member; and then (7) removing said die.

2. A method for producing a stamp pad as claimed in claim 1, wherein the composition of said stamping ink prior to dilution in step (3) comprises 50 to 70% by weight of glycerine, 10 to 15% by weight of pigment, 15 to 20% by weight of a poly vinyl pyrolidone, and 5 to 12% by weight of a lanolin; said stamping ink having a viscosity of 71,500 cps.

3. A method for producing a stamp pad as claimed in claim 1, wherein said diluent is water.

4. A method for producing a stamp pad as claimed in claim 1, wherein the content of said stamping ink in said porous padding member is 80 to 100% of the saturation content of said porous padding member in step (5).

* * * * *